US005429795A

United States Patent [19]

Müller

[11] Patent Number: 5,429,795

[45] Date of Patent: Jul. 4, 1995

[54] 10-CARAT GOLD ALLOY FOR ORNAMENTS

[76] Inventor: Manfred Müller, Steinenlandstrabe 14, D-75181 Pforzeim, Germany

[21] Appl. No.: 286,947

[22] Filed: Aug. 8, 1994

[30] Foreign Application Priority Data

Nov. 12, 1993 [DE] Germany ..... 93 17 318.0 U
Mar. 25, 1994 [DE] Germany ..... 94 05 105.4 U

[51] Int. Cl.[6] ..... C22C 5/02
[52] U.S. Cl. ..... 420/507; 420/511
[58] Field of Search ..... 420/507, 511

[56] References Cited

U.S. PATENT DOCUMENTS 5,340,529 8/1994 DeWitt ..... 420/511

*Primary Examiner*—Peter D. Rosenberg
*Attorney, Agent, or Firm*—Dvorak and Traub

[57] ABSTRACT

A 10-carat gold alloy for ornaments comprises 41.7% gold 12.0 to 13.0% silver, 40 to 41.5% copper, and 4.5 to 5.5% zinc.

4 Claims, No Drawings

10-CARAT GOLD ALLOY FOR ORNAMENTS

BACKGROUND OF THE INVENTION

1. Field of the Invention

This invention relates to a 10-carat gold alloy comprising 41.7% gold and alloying constituents consisting of silver, copper, and zinc.

2. Description of the Prior Art

As the gold content of a gold alloy decreases, it will be increasingly more difficult to provide an alloy having the typically gold-yellow hue which is desired by the buyers of ornaments. Besides, the composition of the alloy must be determined not only with a view to its hue but also with a view to the processing properties of the alloy. For this reason, two types of alloys have been successful among low-carat gold alloys (8 carats, 9 carats, 10 carats), namely, in the first place, which can be processed in chain-making machines and for this reason is relatively soft because it has relatively high brass and copper contents so that the alloy has a reddish hue, which is not particularly desired by the buyers. The other alloy is used for making (centrifugally) cast ornaments and for this reason must be much harder and for that purpose has a higher silver content so that the alloy is light-yellow and paler than is desired.

For this reason it is usual in the making of ornaments from low-carat gold alloys to correct the hue in that the ornaments is plated with a very thin gold layer by a treatment in a high-carat electrolytic gold bath. Such a thin gold layer is also described as a flash.

French Patent Specification 2,305,523 discloses a 5-carat gold alloy which contains 37,5% gold, 38,5 to 59% copper, 3.5 to 9% silver, and 0 to 15% zinc. That alloy has allegedly good soldering properties but owing to its wide composition ranges its hue and its processing properties may be within such wide ranges that they cannot be defined by statements which would be applicable in general.

German Patent Specification 30 01 591 discloses a 10-carat gold alloy which contains 43.8 to 44.9% copper, 7.9 to 9.44% silver, and 3.9 to 6.5% zinc. A 10-carat gold alloy containing 44 to 44.7% copper, 8.3 to 9% silver, and 4.5 to 5.9% zinc is preferred. That alloy is allegedly deformable and requires no very thin gold plating. But it is too reddish to be favored by the public and is too soft for a convenient processing (except on chain-making machines). Whereas the hue might be improved by an addition of nickel, nickel is increasingly rejected because it is not compatible (nickel allergy) and for this reason can no longer be added to alloys for ornaments.

SUMMARY OF THE INVENTION

It is an object of the invention to provide a 10-carat gold alloy which is free of nickel and has a hue which is close to the preferred hue N2 and which can be processed on chain-making machines and by deepdrawing (to make lockets from a gold alloy sheet material) and by a casting process which is conventionally used to make ornaments.

That object is accomplished by a gold alloy which has the composition described in claim 1 or claim 2 and optimally contains 12.5% by weight silver, 40.8% by weight copper, and 5% by weight zinc.

DETAILED DESCRIPTION OF THE PREFERRED EMBODIMENTS

Surprisingly it has been found that said alloy has not only a pleasing hue but in a cast state has also a medium hardness corresponding to VHN 150, which permits a convenient processing. Experiments have shown that wires made of the alloy can be processed in chain-making machines and that the alloy although its zinc content is unusual for centrifugally castable alloys can be processed by vacuum centrifugal casting. By cold-working the hardness of the alloy can be increased to VHN 250, which can be achieved, e.g., by a rolling with a deformation (thickness reduction) of 50%. The hardness achieved by cold working can be eliminated in that the alloy is annealed, e.g., in the air at 650° C. for 10 to 20 minutes and subsequently quenched and low hardness corresponding to a VHN of about 130 can thus be achieved. With such a hardness, plates made of the alloy in accordance with the invention can deeply be drawn very easily so that, e.g., locket shells can very easily be made from that alloy. In that case it has been found that a further advantage resides in that the hardness of the locket half-shells is increased by the deep-drawing, typically to a VHN of about 190, so that an adequate mechanical stability can be achieved even if the locket half-shells have small wall thicknesses of only 0.2 to 0.3 mm. The hardness which results from the deepdrawing can be preserved until a succeeding soldering operation, which can be performed, e.g., at 750 to 780° C. in a tunnel furnace. To prepare the alloy, its components in the claimed proportions are melted at about 1000° C. in a melting crucible and the melt is poured into a cup, which is at 650° C. and in which the alloy is allowed to cool in air. The alloy has a pleasing deep yellow hue, which is similar to the hue N2.

I claim:

1. An alloy for improved manufacturing of chain-making, deep drawing, workability and casting, the alloy consisting of approximately 41.7% gold and also containing silver, copper, and zinc, characterized in that the alloy contains approximately 12.0 to 13.0% silver, approximately 40.0 to 41.5% copper, and approximately 4.5 to 5.5% zinc, wherein the alloy has a gold-yellow hue.

2. An alloy as claimed in claim 1 characterized in that the alloy contains 12.5 % by weight silver, 40.8 % by weight copper, and 5 % by weight zinc.

3. An alloy as claimed in claim 1 characterized in that the alloy has a gold yellow hue which is similar to the hue N2.

4. An alloy as claimed in claim 1 characterized in that the alloy has a medium hardness substantially corresponding to VHN 150 in a cast state.

* * * * *